US012225928B2

(12) United States Patent
Whiffen et al.

(10) Patent No.: US 12,225,928 B2
(45) Date of Patent: Feb. 18, 2025

(54) APPARATUS AND METHOD FOR PRODUCING A ROD OF AEROSOL-GENERATING MATERIAL

(71) Applicant: British American Tobacco (Investments) Limited, London (GB)

(72) Inventors: Sam Whiffen, London (GB); Andrew Jonathan Bray, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 195 days.

(21) Appl. No.: 17/414,610

(22) PCT Filed: Dec. 11, 2019

(86) PCT No.: PCT/GB2019/053513
§ 371 (c)(1),
(2) Date: Jun. 16, 2021

(87) PCT Pub. No.: WO2020/141301
PCT Pub. Date: Jul. 9, 2020

(65) Prior Publication Data

US 2022/0053819 A1 Feb. 24, 2022

(30) Foreign Application Priority Data

Jan. 4, 2019 (GB) ..... 1900138

(51) Int. Cl.
*A24C 5/18* (2006.01)
*A24B 3/14* (2006.01)
(Continued)

(52) U.S. Cl.
CPC ..... *A24C 5/1828* (2013.01); *A24C 5/1857* (2013.01); *A24C 5/20* (2013.01); *A24B 3/14* (2013.01); *A24D 1/20* (2020.01)

(58) Field of Classification Search
CPC ..... A24C 5/1828; A24C 5/1857; A24C 5/20; A24D 1/20; A24B 3/14; B65H 19/181;
(Continued)

(56) References Cited

U.S. PATENT DOCUMENTS 3,472,236 A 10/1969 Dearsley
3,583,373 A * 6/1971 Hooper ..... A24C 5/18 131/20

(Continued)

FOREIGN PATENT DOCUMENTS

EP 0246107 A2 11/1987
GB 1279724 6/1972

(Continued)

OTHER PUBLICATIONS

International Search Report for corresponding application PCT/GB2019/053501 filed Dec. 11, 2019; Mail date Mar. 5, 2020.

(Continued)

*Primary Examiner* — Christopher M Rodd
*Assistant Examiner* — Ronnie Kirby Jordan
(74) *Attorney, Agent, or Firm* — CANTOR COLBURN LLP

(57) ABSTRACT

Apparatus for producing a rod of aerosol-generating material is disclosed. The apparatus comprises a first feed device adapted to supply a first web of aerosol-generating material to a processing unit, a second feed device adapted to supply a second web of aerosol-generating material, and a web changeover unit arranged to change supply of aerosol-generating material to the processing unit from the first web of aerosol-generating material to the second web of aerosol-generating material. The web changeover unit is configured to position a leading edge of the second web of aerosol-generating material adjacent to a trailing edge of the first web of aerosol-generating material upstream of the process- (Continued)

ing unit during changeover from the first web of aerosol-generating material to the second web of aerosol-generating material. A method of producing a rod of aerosol-generating material is also disclosed.

18 Claims, 11 Drawing Sheets

(51) Int. Cl.
*A24C 5/20* (2006.01)
*A24D 1/20* (2020.01)

(58) Field of Classification Search
CPC ..... B65H 19/1805; B65H 19/1821; B65H 19/1836; B65H 19/1852; B65H 2301/461; B65H 2301/4623; B65H 2301/4631; B65H 2301/4636; D21F 2/00
See application file for complete search history.

(56) References Cited

U.S. PATENT DOCUMENTS

| | | | | |
|---|---|---|---|---|
| 3,645,273 | A | 2/1972 | Richter | |
| 4,047,536 | A | 9/1977 | Asfour | |
| 4,579,293 | A | 4/1986 | Steiniger | |
| 4,605,013 | A | 8/1986 | Goldbach | |
| 5,018,535 | A | 5/1991 | Da Silva | |
| 5,649,551 | A | 7/1997 | Bottger | |
| 5,902,431 | A * | 5/1999 | Wilkinson et al. | A24C 5/20 156/159 |
| 6,705,325 | B1 | 3/2004 | Hicks | |
| 6,807,969 | B1 | 10/2004 | Wessinger | |
| 2002/0185143 | A1 | 12/2002 | Crooks | |
| 2015/0150302 | A1 * | 6/2015 | Metrangolo et al. | A24C 5/18 |
| 2017/0233210 | A1 | 8/2017 | Kummel | |
| 2018/0064160 | A1 | 3/2018 | Gindrat | |
| 2018/0079614 | A1 * | 3/2018 | Pasquale | B65H 19/1826 |

FOREIGN PATENT DOCUMENTS

| | | | |
|---|---|---|---|
| WO | 2015173275 | A1 | 11/2015 |
| WO | 2018211116 | A1 | 11/2018 |
| WO | 2018229087 | A1 | 12/2018 |

OTHER PUBLICATIONS

International Search Report for corresponding application PCT/GB2019/053513 filed Dec. 11, 2019; Mail date Mar. 6, 2020.
Written Opinion of the International Searching Authority for corresponding application PCT/GB2019/053501 filed Dec. 11, 2019; Mail date Mar. 5, 2020.
Written Opinion of the International Searching Authority for corresponding application PCT/GB2019/053513 filed Dec. 11, 2019; Mail date Mar. 6, 2020.
Japanese Office Action for corresponding application No. 2023051149; Report dated Jun. 4, 2024.

* cited by examiner

APPARATUS AND METHOD FOR PRODUCING A ROD OF AEROSOL-GENERATING MATERIAL

FIELD

The present invention relates to apparatus and method for producing a rod of aerosol-generating material, for example a tobacco rod.

BACKGROUND

In a known process of manufacturing cigarettes, tobacco leaves are shredded into short fine strips, also referred to as cut rag tobacco. The shredded tobacco is then dispersed over a continuous web of cigarette paper. A machine, also known as a cigarette maker, folds the paper around the shredded tobacco to form a continuous rod. The rod is cut into segments of desired length. A filter is added to each tobacco rod segment to produce the cigarette.

Smoking articles such as cigarettes, cigars and the like burn tobacco during use to create tobacco smoke. Attempts have been made to provide alternatives to these articles by creating products that release compounds from tobacco or other materials without combusting. Examples of such products are so-called "heat not burn" products or tobacco heating devices or products or aerosol-generating devices or products, which release compounds by heating, but not burning, material, such as tobacco.

SUMMARY

In accordance with the present invention, there is provided apparatus for producing a rod of aerosol-generating material, the apparatus comprising:

- a first feed device adapted to supply a first web of aerosol-generating material to a processing unit;
- a second feed device adapted to supply a second web of aerosol-generating material; and
- a web changeover unit arranged to change supply of aerosol-generating material to the processing unit from the first web of aerosol-generating material to the second web of aerosol-generating material;
- wherein the web changeover unit is configured to position a leading edge of the second web of aerosol-generating material adjacent to a trailing edge of the first web of aerosol-generating material upstream of the processing unit during changeover from the first web of aerosol-generating material to the second web of aerosol-generating material.

The web changeover unit may be configured to position the leading edge of the second web of aerosol-generating material to abut the trailing edge of the first web of aerosol-generating material.

The web changeover unit may be configured to position the leading edge of the second web of aerosol-generating material relative the trailing edge of the first web of aerosol-generating material such that a space is defined between the leading edge of the second web of aerosol-generating material and the trailing edge of the first web of aerosol-generating material.

The space may be less than 20 mm, preferably less than 10 mm, more preferably less than 5 mm.

The web changeover unit may be configured to position the leading edge of the second web of aerosol-generating material adjacent to the trailing edge of the first web of aerosol-generating material without overlap between the first web of aerosol-generating material and the second web of aerosol-generating material.

The web changeover unit may not attach the second web of aerosol-generating material to the first web of aerosol-generating material.

The apparatus may further comprise a support arranged to carry the leading edge of the second web of aerosol-generating material to the processing unit.

The leading edge of the second web of aerosol-generating material and the trailing edge of the second web of aerosol-generating material may be complementarily shaped.

The leading edge of the second web of aerosol-generating material and the trailing edge of the second web of aerosol-generating material may be diagonal relative to the direction of travel of the first web leading edge of the second web of aerosol-generating material and the second web of aerosol-generating material.

The apparatus may further comprise a cutting unit arranged to cut the first web of aerosol-generating material to define the trailing edge.

The apparatus may further comprise a cutting unit arranged to cut the second web of aerosol-generating material to define the leading edge.

The cutting unit may be further arranged to cut the second web of aerosol-generating material to define the leading edge.

The cutting unit may comprise a blade that extends diagonally across the web of aerosol-generating material.

The web changeover unit may comprise a nip drive roller configured to drive the second web of aerosol-generating material.

The web changeover unit may further comprise a sensor for detecting the positions of the leading edge of the second web of aerosol-generating material and the trailing edge of the first web of aerosol-generating material.

The apparatus of may further comprise a controller configured to control the nip drive roller to position the leading edge of the second web of aerosol-generating material adjacent to the trailing edge of the first web of aerosol-generating material.

The apparatus may further comprise a further web feed unit for providing a further web of aerosol-generating material to the processing unit, the further web of aerosol-generating material being arranged to overlap with the web of aerosol-generating material in the processing unit.

The further web feed unit may comprise:

- a first feed device adapted to supply a first web of aerosol-generating material to the processing unit;
- a second feed device adapted to supply a second web of aerosol-generating material; and
- a web changeover unit arranged to change supply of aerosol-generating material to the processing unit from the first web to the second web;
- wherein the web changeover unit is configured to position a leading edge of the second web of aerosol-generating material adjacent to a trailing edge of the first web of aerosol-generating material upstream of the processing unit.

The apparatus may further comprise an embossing unit configured to emboss the second web of aerosol-generating material to the further web of aerosol-generating material.

The embossing unit may be configured to emboss a portion of the second web of aerosol-generating material adjacent to the leading edge to the further web of aerosol-generating material.

The process unit is may be a slitting unit for slitting the web of aerosol-generating material into a plurality of strands of aerosol-generating material.

The apparatus may further comprise a conveyor configured to group together the strands of aerosol-generating material.

The apparatus may further comprise a suction conveyor arranged to receive the strands of aerosol-generating material.

The apparatus may further comprise a garniture configured to wrap the strands of aerosol-generating material to form a continuous rod.

The apparatus may further comprise a cutter arranged to cut the continuous rod into discrete rod segments.

The aerosol-generating material may comprise tobacco.

The aerosol-generating material may comprise reconstituted tobacco sheet.

According to the invention, there is also provided a method of producing a rod of aerosol-generating material, the method comprising:

supplying a first web of aerosol-generating material to a processing unit;

supplying a second web of aerosol-generating material; and changing the supply of aerosol-generating material to the processing unit from the first web of aerosol-generating material to the second web of aerosol-generating material;

wherein the step of changing the supply of aerosol-generating material comprises positioning a leading edge of the second web of aerosol-generating material adjacent to a trailing edge of the first web of aerosol-generating material upstream of the processing unit.

The method may comprise positioning the leading edge of the second web of aerosol-generating material to abut the trailing edge of the first web of aerosol-generating material.

The method may comprise positioning the leading edge of the second web of aerosol-generating material relative the trailing edge of the first web of aerosol-generating material such that a space is defined between the leading edge of the second web of aerosol-generating material and the trailing edge of the first web of aerosol-generating material.

The space may be less than 20 mm, preferably less than 10 mm, more preferably less than 5 mm.

The method may comprise positioning the leading edge of the second web of aerosol-generating material adjacent to the trailing edge of the first web of aerosol-generating material without overlap between the first web of aerosol-generating material and the second web of aerosol-generating material.

The step of changing the supply of aerosol-generating material may not comprise attaching the second web of aerosol-generating material to the first web of aerosol-generating material.

The method may comprise cutting the first web of aerosol-generating material to define a trailing edge.

The method may further comprising cutting the second web of aerosol-generating material to define a leading edge.

The trailing edge of the first web of aerosol-generating material and the leading edge of the second web of aerosol-generating material may be cut to have complementary shapes.

The trailing edge of the first web of aerosol-generating material and the leading edge of the second web of aerosol-generating material may be diagonal.

The method may comprise supplying a further web of aerosol-generating material to the processing unit.

The method may comprise embossing the second web of aerosol-generating material to the further web of aerosol-generating material.

The process unit may be a slitting unit, and the method may further comprise slitting the web of aerosol-generating material into a plurality of strands of aerosol-generating material.

The method may further comprising grouping together the strands of aerosol-generating material.

The method may further comprise conveying the strands of aerosol-generating material on a suction conveyor.

The method may further comprise wrapping the strands of aerosol-generating material to form a continuous rod.

The method may further comprise cutting the continuous rod into discrete rod segments.

The aerosol-generating material may comprise tobacco.

The aerosol-generating material may comprise reconstituted tobacco sheet.

BRIEF DESCRIPTION OF THE DRAWINGS

Embodiments will now be described, by way of example only, with reference to the accompanying drawings, in which.

DETAILED DESCRIPTION

Figure 1A:
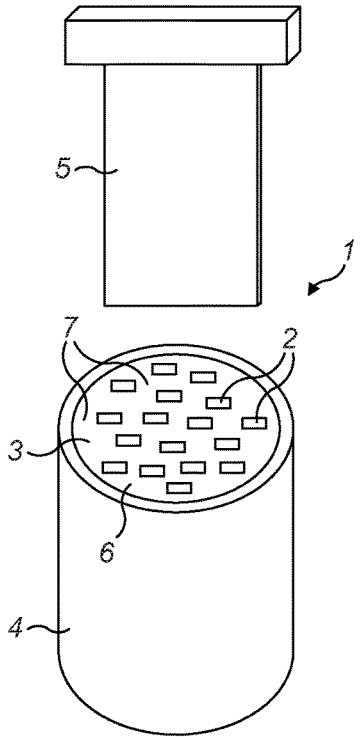
FIGS. 1A and 1B show a tobacco rod segment and a part of an aerosol-generating device, specifically a heating blade.
Figure 1B:
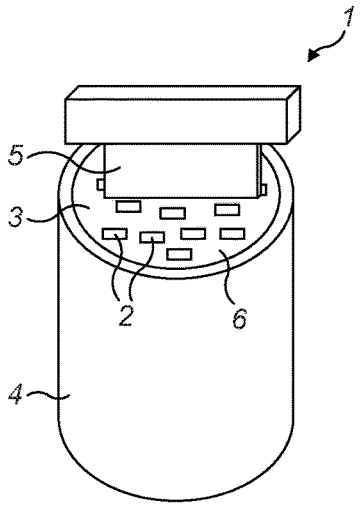

The apparatus described herein is for producing rods of aerosol-generating material. In examples, the rods of aerosol-generating material are tobacco rod segments 1, as shown in FIGS. 1A and 1B. The tobacco rod segments 1 are formed of a plurality of tobacco strands 2 that extend longitudinally along a tobacco rod 3 of the tobacco rod segment 1. The tobacco rod segment 1 also includes a wrapper 4 that circumscribes the tobacco rod 3.

The tobacco strands 2 are preferably formed from a sheet of tobacco material, for example a sheet of reconstituted tobacco. The sheet of reconstituted tobacco can be slit into a plurality of tobacco strands 2 for incorporation into a tobacco rod 3. Reconstituted tobacco sheets may be produced, for example, by a paper making process, band casting or extrusion. For example, the reconstituted tobacco sheet may be paper reconstituted tobacco. Paper reconstituted tobacco refers to tobacco material formed by a process in which tobacco feedstock is extracted with a solvent to afford an extract of solubles and a residue comprising fibrous material, and then the extract (usually after concentration, and optionally after further processing) is recombined with fibrous material from the residue (usually after refining of the fibrous material, and optionally with the addition of a portion of non-tobacco fibres) by deposition of the extract onto the fibrous material. The process of recombination resembles the process for making paper. The feedstock may comprise or consist of one or more of tobacco strips, tobacco stems, and/or whole leaf tobacco. Scraps, fines and winnowings may alternatively or additionally be employed in the feedstock. It will be appreciated that reconstituted tobacco sheet formed by any process may be used. The reconstituted tobacco sheet is malleable.

Referring to FIGS. 1A and 1B, the tobacco strands 2 in the tobacco rod 3 extend in a direction of a length of the tobacco rod 3, wherein each of the plurality of longitudinal strands 2 are substantially non-coiled. The plurality of tobacco strands 2 are substantially parallel to one another, substantially straight, and each extend along substantially the entire length of the tobacco rod segment 1.

The wrapper 4 circumscribing the tobacco strands 2 is preferably made of paper. The wrapper 4 may, for example, be or comprise one or both of paper and aluminium foil, for example a laminate of paper and aluminium foil. The wrapper 4 may have a glued seam that secures the wrapper 4 about the tobacco rod 3.

As described in further detail hereinafter, a process for producing the tobacco rod segments 1 can include slitting a reconstituted tobacco sheet into tobacco strands 2, grouping together the tobacco strands 2, wrapping the tobacco strands 2 in a wrapper 4 to form a continuous tobacco rod, and then cutting the continuous tobacco rod into discrete tobacco rod segments 1. The step of grouping together the tobacco strands 2 can be performed on a conveyor, and such a conveyor is described in detail hereinafter.

Heating the tobacco strands 2 can release an aerosol for inhalation by a user. The tobacco rod segments 1 can be used with an aerosol-generating device that includes a heating blade 5. The heating blade 5 can be inserted into an end 6 of the tobacco rod segment 1, between tobacco strands 2, as shown in FIGS. 1A and 1B.

The reconstituted tobacco sheet used to produce the tobacco strands 2 may comprise glycerol. For example, the reconstituted tobacco sheet may be impregnated or otherwise formed with glycerol. When heated, the glycerol may be volatilised to form an aerosol, which may enhance user experience of an aerosol-generating device, or any suitable "heat not burn" device, with which the tobacco rod segment 1 may be used.

The blade heater 5 can take the form of an elongate cuboid that is significantly thinner than it is wide or long. The width of the blade heater 5 is less than the outer diameter of the tobacco rod segment 1. The blade heater 5 may comprise a resistive heater (not shown) powered by a battery (not shown) of a hand-held aerosol generating device (not shown) and which is controllable by a user to heat up. In some examples, the blade heater 5 may have a pointed end (not shown) so as to facilitate insertion of the blade heater 5 into the tobacco rod segment 1.

The blade heater 5 may be inserted into the tobacco rod segment 1, or equally the tobacco rod segment 1 may be pushed over the blade heater 5, so that the blade heater 5 extends longitudinally into the tobacco rod segment 1 as shown in FIG. 1B.

The plurality of longitudinally extending tobacco strands 2 of the tobacco rod segment 1 being substantially non-coiled allows the blade heater 5 to be easily inserted into the tobacco rod segment 1. This is because the non-coiled tobacco strands 2 present relatively little resistance to longitudinal insertion of the blade heater 5. This may provide for convenient installation or replacement of the tobacco rod segment 1 onto the blade heater 5, which tobacco rod segment 1 may be a consumable of the overall aerosol generating device (not shown). This may reduce damage to the tobacco rod segment 1 on insertion of the blade heater 5, and allow for more consistent and correct placement of the tobacco rod segment 1 relative to the blade heater 5. This may be contrasted, for example, with a hypothetical tobacco rod segment comprising longitudinal strands that are coiled, for example arranged in a helical structure: in this case insertion of the blade heater would be restricted by strands crossing the insertion path, and the blade heater may deform and compress portions of the tobacco, which may lead to relatively difficult and inconsistent placement of the hypothetical tobacco rod segment, and may result in an increased risk of damaging the hypothetical tobacco rod segment.

The plurality of longitudinally extending tobacco strands 2 of the tobacco rod segment 1 being parallel to one another and/or straight similarly allows the blade heater 5 to be easily inserted into the tobacco rod segment 1. In this case, the axis of insertion of the blade heater 5 is parallel to the axis of each of the longitudinal strands 2, and only a small surface area of tobacco is presented to the leading edge of the blade heater 5 as it is inserted. Similarly to as mentioned above, this may provide for convenient installation or replacement of the tobacco rod segment 1 and/or reduce damage to the tobacco rod segment 1, and/or provide for more consistent and correct placement of the tobacco rod segment 1 relative to the blade heater 5. This may be contrasted, for example, with a hypothetical tobacco rod segment comprising randomly oriented shreds of cut rag tobacco, or comprising crimped or corrugated sheets of tobacco: in this case insertion of a blade heater may deform and compress portions of the cut rag tobacco or edges of the crimped or corrugated sheets of tobacco, which may lead to relatively difficult and inconsistent placement of the hypothetical tobacco rod segment, and may result in an increased risk of damaging the hypothetical tobacco rod segment.

Once the tobacco rod segment 1 is inserted over the blade heater 5 of the overall aerosol generating device (not shown), the blade heater 5 may be controlled to heat up (for example via resistive heating internal of the blade heater), and thereby to heat, but not burn, the tobacco strands 2. This may release constituents, for example volatile constituents, from the tobacco strands 2. As mentioned above, the tobacco strands 2 may comprise glycerol, which may be volatilised when heated by the blade heater 5 to form an aerosol.

The plurality of substantially non-coiled longitudinal tobacco strands 2 of the tobacco rod segment 1 establish a corresponding plurality of substantially non-coiled longitudinal pathways 7 through the tobacco rod segment 1, in between the plurality of tobacco strands 2. These pathways 7 facilitate the transport of volatile materials released from the tobacco strands 2 on heating (for example volatile constituents of the tobacco itself or volatilised glycerol or both) through the tobacco rod segment 1. This may reduce the losses of such materials as they pass through the tobacco rod segment 1, for example the relatively short and uninterrupted pathways may reduce occurrences of condensation of the volatile materials back onto portions of the tobacco rod segment 1. This may be contrasted for example, with a hypothetical tobacco rod segment comprising randomly oriented shreds of cut rag tobacco (such as in standard cigarettes), in which the path length for volatilised materials to exit the hypothetical tobacco rod is relatively long. This may also be contrasted with a hypothetical tobacco rod segment comprising a plurality of coiled longitudinal strands, in which the path length for volatilised materials to exit the hypothetical tobacco rod is also relatively long.

As described above, the wrapper 4 may, for example, be or comprise one or both of paper and aluminium foil, for example a laminate of paper and aluminium foil. The laminate of paper and aluminium foil may be useful to prevent the tobacco rod segment 1 from being ignited by the blade heater 5. The aluminium foil may also be useful to prevent a consumer from igniting a tobacco rod segment 1 like a conventional cigarette when the tobacco rod segment 1 is intended for use with a heating device.

Each of the plurality of tobacco strands 2 may have a width substantially in the range 0.25 mm to 3 mm, or substantially in the range 0.5 mm to 1.5 mm. The tobacco rod segment 1 may have an outer diameter substantially in the range 5.4 mm to 7.8 mm, or substantially in the range 6.7 mm to 7.8 mm. This may allow the use of a relatively large blade heater 5, hence increasing the heating surface area of the blade heater 5, hence increasing the rate at which the tobacco strands 2 may be heated and/or the amount of tobacco strands 2 that may be heated by the blade heater 5.

Figure 2:
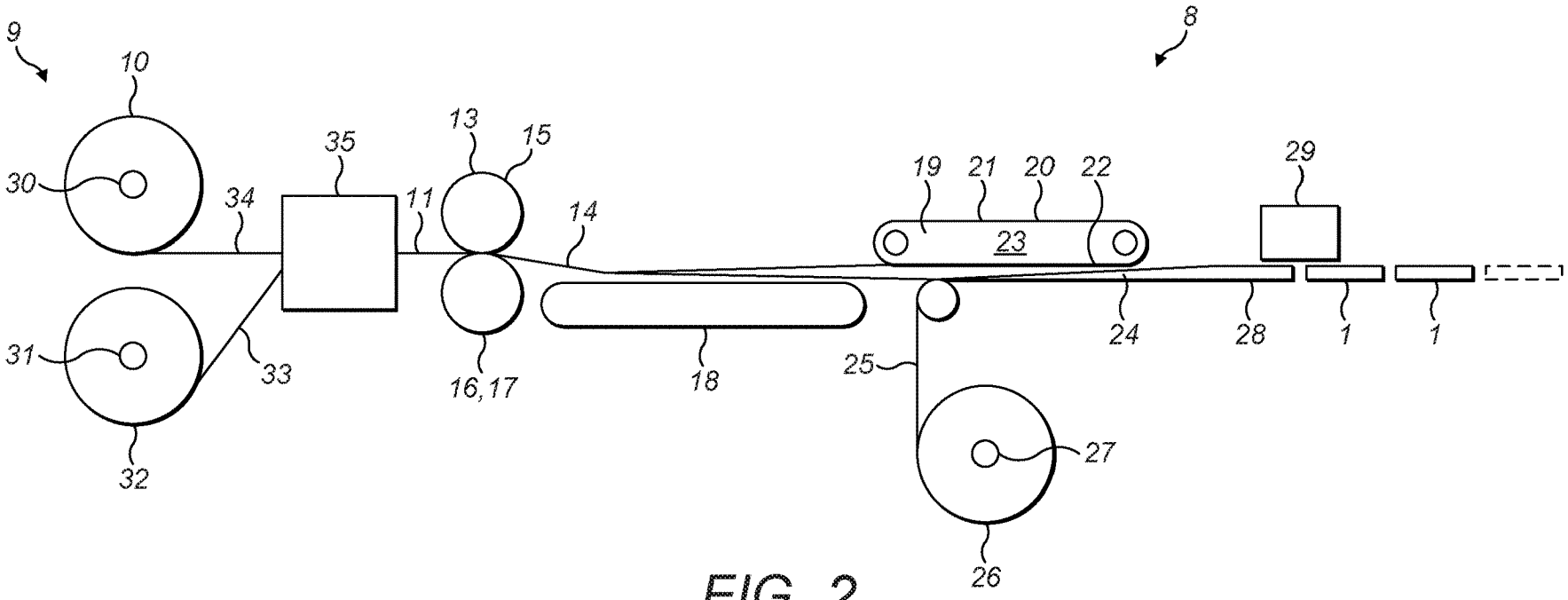
FIG. 2 shows a schematic diagram of apparatus for producing tobacco rod segments.

FIG. 2 schematically illustrates apparatus 8 for producing rods of aerosol-generating material, in particular the tobacco rod segments 1 described with reference to FIGS. 1A and 1B.

The reconstituted tobacco sheet used to produce the tobacco strands 2 is provided to the apparatus 8 in the form of a tobacco web 11. The apparatus 8 includes tobacco web feed unit 9 that feeds a tobacco web 11 into the apparatus 8. The tobacco web feed unit 9 includes a first reel support 30 that supports a first reel 10. A first tobacco web 34 is provided from the first reel 10. The tobacco web feed unit 9 also includes a second reel support 31 that supports a second reel 32. A second tobacco web 33 is provided from the second reel 32. The tobacco web feed unit 9 also includes a web changeover unit 35 that receives the first tobacco web 34 and the second tobacco web 33. In the arrangement illustrated in FIG. 2, the first tobacco web 34 pass through the web changeover unit 35 and is supplied to the remainder of the apparatus 8 as the tobacco web 11. Then, when the first reel to is empty or nearly empty, the web changeover unit 35 changes supply of the tobacco web 11 from the first tobacco web 34 to the second tobacco web 33 so that the apparatus 8 can continue to run. A replacement first reel to can be loaded, and once the second reel 32 is empty or nearly empty, the web changeover unit 35 can change supply of the tobacco web 11 from the second tobacco web 33 to the first tobacco web 34.

The first reel support 30 and the second reel support 31 both include a spindle on which the reels 10, 32 of reconstituted tobacco are supported. The first and second reel supports 30, 31 each preferably include a drive, for example a motor, that rotates the spindle to drive the tobacco web 34, 33 into the apparatus 8. Alternatively or additionally, a drive roller may engage an outer surface of the reel 10, 32 to rotate the reel 10, 32, thereby feeding the tobacco web 33, 34 into the apparatus 8. Alternatively, the spindles may be freely rotatable such that the tobacco web 33, 34 can be unwound by pulling the tobacco web 33, 34 off of the reel 10, 32 of reconstituted tobacco. The tobacco web 33, 34 can be pulled by a part of the apparatus 8 located downstream of the first and second reel supports 30, 31. The spindles may be braked to create and/or control tension in the tobacco webs 33, 34.

The tobacco web 11 is of known dimensions. For example, the width and thickness of the tobacco web 11 fed from the tobacco web feed unit 9 may be constant and known. For example, the tobacco web 11 may be of a given and constant mass per unit length. This may ensure that the tobacco rod segments 1 produced are of consistent weight per unit length. Using a tobacco web 11 of known (and constant) dimensions therefore allows weight control of the resulting tobacco rod segments 1 without the need for weighing systems for weighing the tobacco rod or tobacco rod segments 1.

The tobacco web 11 is fed into a slitting unit 13 that slits the tobacco web 11 into a plurality of tobacco strands 14. The slitting unit 13 slits the tobacco web 11 longitudinally to produce longitudinally extending tobacco strands 14.

In one example, the slitting unit 13 comprises a cutting roller 15 and an anvil roller 16. The cutting roller 15 includes an array of circumferential cutting blades that cut the tobacco web 11 as it is passed between the cutting roller 15 and the anvil roller 16. Alternatively, the slitting unit 13 may comprises a first cutting roller 15 and a second cutting roller 17, each having an array of circumferential cutting blades that cooperate to slit the tobacco web 11. For example, the circumferential cutting blades of the first cutting roller 15 may closely overlap with the circumferential cutting blades of the second cutting roller 17 to shear cut the tobacco web 11 into tobacco strands 14.

The array of circumferential cutting blades on the or each cutting roller 15, 17 determines the number of tobacco strands 14 and the size of the tobacco strands 14. The tobacco strands 14 are preferably all equal in width. The array of circumferential cutting blades on the or each cutting roller 15, 17 may be arranged such that each tobacco strand 14 has a width substantially in the range 0.25 mm to 3 mm, or substantially in the range 0.5 mm to 1.5 mm. This would correspond, for example, to the circumferential cutting blades being spaced apart by substantially 0.25 mm to 3 mm, or substantially 0.5 mm to 1.5 mm, respectively.

The distance between the cutting roller 15 and the anvil roller 16, or between the first cutting roller 15 and the second cutting roller 17, may be fixed. Alternatively, one of the cutting roller 15 and the anvil roller 16, or one of the first cutting roller 15 and the second cutting roller 17, may be slidably mounted, and an actuator may be arranged to apply hydraulic or pneumatic pressure between the cutting roller 15 and the anvil roller 16, or between the first cutting roller 15 and the second cutting roller 17.

From the output of the slitting unit 13 the tobacco strands 14 are passed onto a conveyor 18, which is described in more detail with reference to FIGS. 3 to 7. The conveyor 18 is configured to convey the tobacco strands 14. Preferably, the tobacco strands 14 are grouped together as they are conveyed along the conveyor 18.

Figure 4:
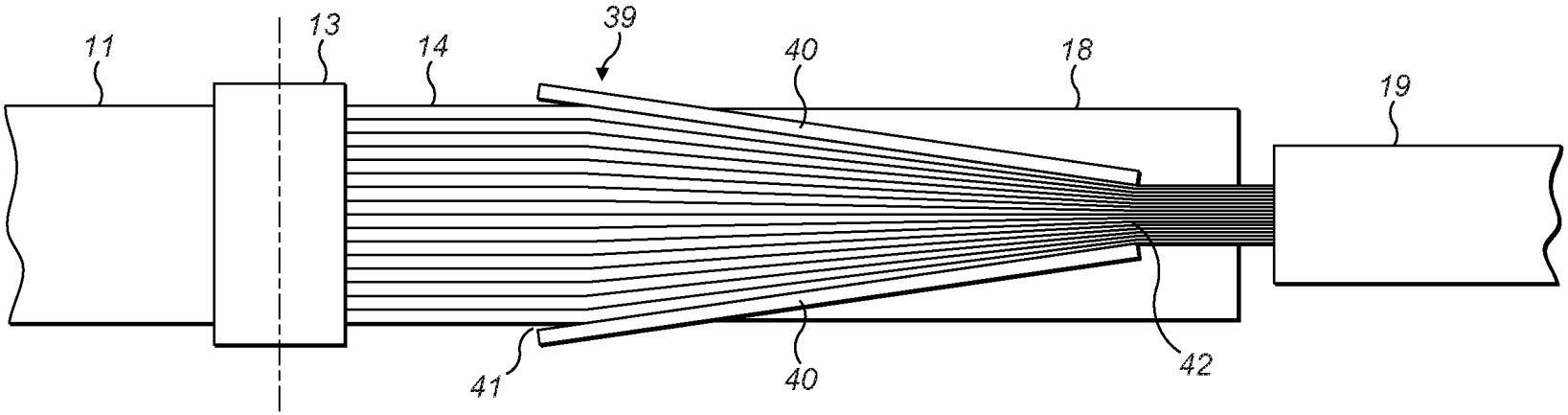
FIG. 4 shows the conveyor of the apparatus of FIGS. 2 and 3.

FIG. 4 illustrates an example of the conveyor 18. As shown, the conveyor includes a guide 39. In this example, the conveyor 18 includes a pair of rails 40 angled towards each other to group together the tobacco strands 14. The pair of rails 40 are arranged as a funnel, with a wider inlet 41 disposed towards the slitting unit 13 and a narrower outlet 42 disposed towards the suction conveyor 19. The pair of rails 40 move the outer lying tobacco strands 14 towards the middle of the conveyor 18 to group them together. The angle of the pair of rails 40 relative to the conveying direction of the tobacco strands 14 can be selected such that the forces placed on the tobacco strands 14 are acceptable—a lower angle of rail 40 will result in lower forces being applied to the tobacco strands 14.

The conveyor 18 may be a belt conveyor that carries the tobacco strands 14 from the slitting unit 13 to the suction conveyor 19. Alternatively, the conveyor 18 may be a surface over which the tobacco strands 14 are pushed and/or pulled. The conveyor 18 supports the tobacco strands 14 as they move from the slitting unit 13 to the suction conveyor 19.

Referring again to FIG. 2, the grouped together tobacco strands 14 at the output of the conveyor 18 are passed onto a suction conveyor 19, illustrated in FIG. 2. The suction conveyor 19 includes a suction band 20. The suction band 20 is driven to move along an upper run 21 and a lower run 22. A suction chamber 23 is provided between the upper run 21 and the lower run 22, and suction applied to the suction chamber 23 acts through suction holes formed in the suction band 20. Suction acts through the suction holes in the suction band 20 only on the lower run 22, because the suction chamber 23 is closed to the upper run 21.

The suction conveyor 20 is arranged to retain the tobacco strands 14 on the lower run 22 of the suction band 20. The suction conveyor 20 conveys the tobacco strands 14 through a garniture 24, as illustrated.

A wrapper web 25 is input into the garniture 24 from a reel 26 of wrapper that is supported on a wrapper reel support 27.

The garniture 24 receives the tobacco strands 14 and the wrapper web 25, and as the tobacco strands 14 and the wrapper web 25 are conveyed along the suction conveyor 19 the garniture 24 wraps the wrapper web 25 about the tobacco strands 14. An adhesive unit is arranged to apply adhesive along one edge of the wrapper web 25 to form a longitudinal seam joining one edge of the wrapper web 25 to the other. In this way, a continuous tobacco rod 28 is produced. The continuous tobacco rod 28 has a group of longitudinal tobacco strands 14 surrounded by a wrapper.

The suction conveyor 19 and the garniture 24 are similar to apparatus used in the manufacture of tobacco rods for use in cigarettes, and so the skilled person will be familiar with the details of the suction conveyor 19 and the garniture 24, and further description is omitted herefrom.

A cutting unit 29 is arranged downstream of the suction conveyor 19 and the garniture 24 to cut the continuous tobacco rod 28 into discrete tobacco rod segments 1, each tobacco rod segment 1 being as described with reference to FIGS. 1A and 1B.

In some examples, the cutting unit 29 cuts the continuous tobacco rod 28 into double-length discrete tobacco rods 1, i.e. two discrete tobacco rods 1 joined end-to-end. For example, the double-length discrete tobacco rods 1 may then be passed onto subsequent apparatus that combines the double-length discrete tobacco rods 1 with other components, for example filters and/or mouthpieces. The subsequent apparatus can also cut the double-length discrete tobacco rods 1 into single-length discrete tobacco rods 1 as described with reference to FIGS. 1A and 1B.

Alternatively or additionally, the discrete tobacco rod segments 1 can be onwardly conveyed to packaging apparatus that packages the tobacco rod segments 1 for sale, distribution and/or storage.

Figure 3:
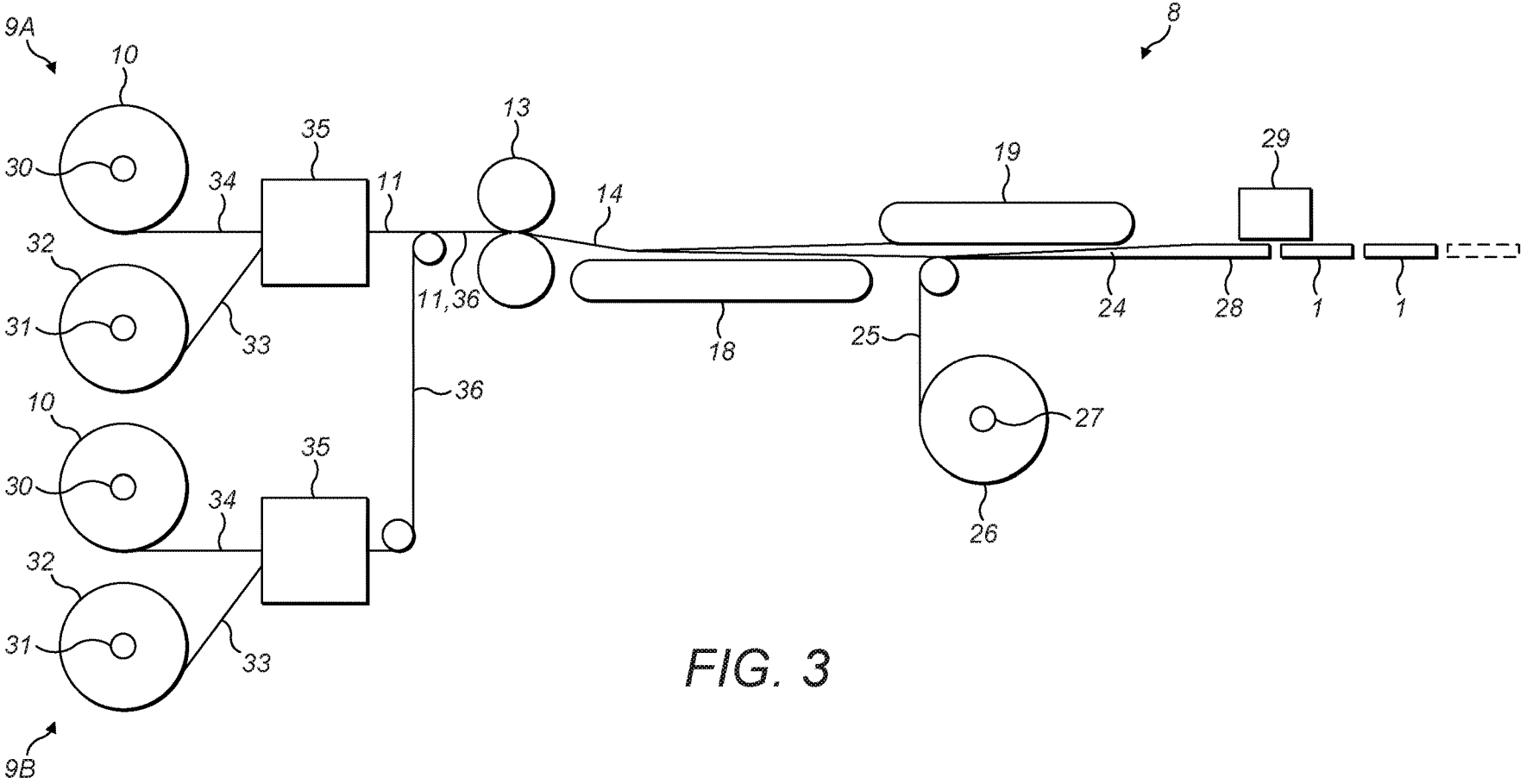
FIG. 3 shows a schematic diagram of a further example apparatus for producing tobacco rod segments.

FIG. 3 shows a further example of the apparatus 8 for producing rods of aerosol-generating material, in particular the tobacco rod segments 1 described with reference to FIGS. 1A and 1B.

As shown, the apparatus 8 of FIG. 3 includes all of the same components as the apparatus 8 of the example of FIG. 2, and further comprises a second tobacco web feed unit 9B (in addition to the first tobacco web feed unit 9A). The second tobacco web feed unit supplies a further tobacco web 36 for input to the slitting unit 13. The further tobacco web 36 is arranged to overlap the tobacco web 11 from the first tobacco web feed unit 9A, thereby providing a double-thickness tobacco web 11, 36 to the slitting unit 13. The double-thickness tobacco web 11, 36 means that the slitting unit 13 will produce a higher density of tobacco strands 14. This arrangement may be preferable if it desired that the individual tobacco strands 14 are particularly thin or low density as it provides for each tobacco rod segment 1 to have twice as many tobacco strands 14. In addition, for the same number of tobacco strands 14, the width of the combined tobacco web 11 and the further tobacco web 32 would be less than the width of a similar thickness single tobacco web 11. Therefore, the tobacco strands 14 producing from overlapping tobacco webs 11, 32 would need less lateral movement to be grouped into a tobacco rod 3, which may be preferable.

Furthermore, providing a further tobacco web 36 means it is possible to provide two different types of tobacco strands 14 in a tobacco rod segment 1. For example, one type (e.g. the tobacco web 11) can have a high glycerol content to generate significant aerosol or vapour, and the other type (e.g. the further tobacco web 36) can include a flavour that is delivered with the aerosol or vapour. In this way, different tobacco rod segments 1 can be made by combining different reels.

The second web feed unit 9 includes a first reel 10, a second reel 32, and a reel changeover over 35 so that supply of the further tobacco web 36 can be changed over to ensure continued supply.

The slitting unit 13 typically has a fixed distance between the cutting rollers 15, 16, 17, and any significant variation in the thickness of the tobacco web 11 can damage and/or jam the slitting unit 13. In addition, any adhesive or tape or other material passing through the slitting unit 13 may clog or otherwise impair operation of the slitting unit 13. Therefore, when changing over from the first tobacco web 34 to the second tobacco web 33 it is advantageous to avoid any overlap between them, or any tape or adhesive join. A typical splicing unit would join the second tobacco web 33 to the first tobacco web 34 in an overlapping area, but it is preferable to avoid such a system in the present invention.

Moreover, as the tobacco web 11, and subsequently the tobacco strands 14, are conveyed provided to the garniture 24 for wrapping to form tobacco rods 1, it is advantageous to avoid significant variations in material weight along the length of the tobacco strands 14 as this would jam or impair function of the garniture 24 (the wrapper 25 would not be wide enough to circumscribe an increased number of tobacco strands 14).

The web changeover unit 35 of the present inventive is configured to position a leading edge of the second tobacco web 33 adjacent to a trailing edge of the first tobacco web 34 at a position upstream of the slitting unit 13 during changeover. The first tobacco web 34 and second tobacco web 33 do not overlap, and there is no attachment between the first tobacco web 34 and second tobacco web 33.

FIGS. 5A to 5E schematically illustrate operation of the web changeover unit 35.

Figure 5A:
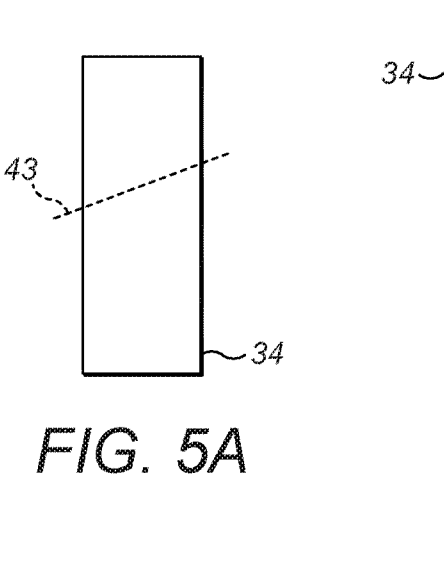
FIGS. 5A to 5E illustrate a process of web changeover from a first reel to a second reel.
Figure 5B:
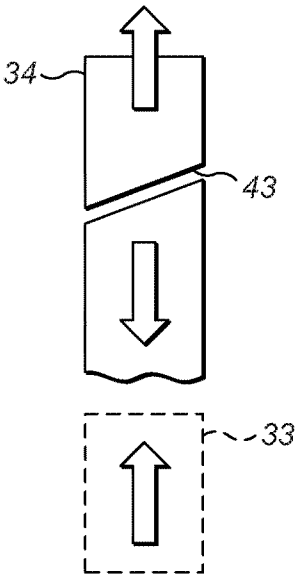
Figure 5C:
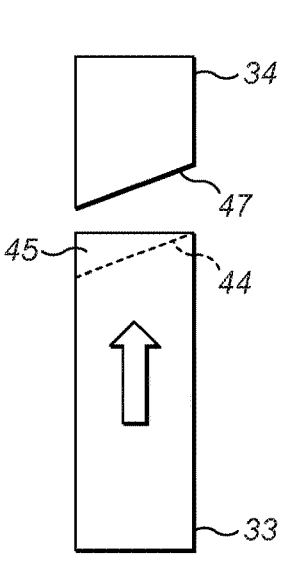

FIG. 5A shows an initial condition of the web changeover unit 35, in which the first tobacco web 34 is intact and passes through the web changeover unit 35 to the slitting unit (13, see FIG. 2). As illustrated in FIG. 5B, a first operation of the web changeover unit 35 comprises cutting the first tobacco web 34. The first tobacco web 34 is cut along line 43. Line 43 is diagonal with respect to the direction of travel of the first tobacco web 34. As shown in FIG. 5B, after cutting the cut off part of the first tobacco web 34 continues to be drawn into the apparatus (8, see FIG. 2), and the remainder, attached to the first reel 10, is pulled back towards the reel 32 for removal from the apparatus 8. The second tobacco web 33 is then accelerated in the direction of the slitting unit (13, see FIG. 2).

The web changeover unit 35 then cuts the second tobacco web 33 along line 44, which matches the cut line 43 in the first tobacco web 34. Cut off part 45 is removed. In this way, the second tobacco web 33 is provided with a leading edge 46 that complements the trailing edge 47 of the first tobacco web 34.

The second tobacco web 33 is then positioned such that the leading edge 46 of the second tobacco web 33 is adjacent to the trailing edge 47 of the first tobacco web 34. The leading edge 46 of the second tobacco web 33 is positioned adjacent to, and not overlapping, the trailing edge 47 of the first tobacco web 34. In particular, there is no overlap between the first tobacco web 34 and the second tobacco web 33.

The leading edge 46 of the second tobacco web 33 may be positioned to abut the trailing edge 47 of the first tobacco web 34. Alternatively, the leading edge 46 of the second tobacco web 33 may be spaced from the trailing edge 47 of the first tobacco web 34. The leading edge 46 of the second tobacco web 33 may be spaced from the trailing edge 47 of the first tobacco web 34 by a distance of less than 20 mm, preferably less than 10 mm, more preferably less than 5 mm.

In some examples, the first tobacco web 34 and the second tobacco web 33 are cut by the same cutter. The first tobacco web 34 and the second tobacco web 33 may be simultaneously cut by the same cutter. Advantageously, the leading edge 46 of the second tobacco web 33 may be spaced from the trailing edge 47 of the first tobacco web 34 would be positioned adjacent to each other by cutting the first and second tobacco webs 34, 33 simultaneously. In other examples, the first tobacco web 34 and the second tobacco web 33 can be cut by separate cutters.

Figure 5D:
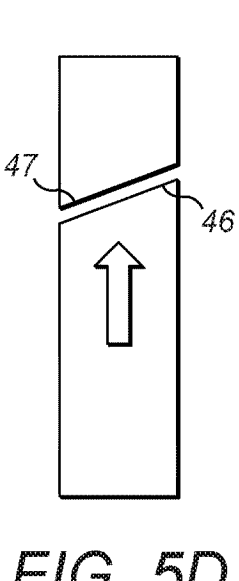
Figure 5E:
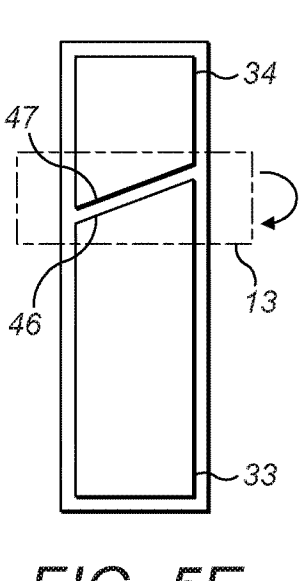

In the position shown in FIG. 5D, in which the leading edge 46 of the second tobacco web 33 is positioned adjacent to, and not overlapping, the trailing edge 47 of the first tobacco web 34, the first and second tobacco webs 34, 33 move through the apparatus (8, see FIG. 2) for production of rods of aerosolizable material, as previously described. As shown in FIG. 5E, the diagonal cut lines 43, 44, and the resultant diagonal leading edge 46 and trailing edge 47, means that the slitting unit 13 can grip both the first tobacco web 34 and the second tobacco web 33 simultaneously, thereby maintaining the positions of the leading edge 46 of the second tobacco web 33 and the trailing edge 47 of the first tobacco web 34.

In addition, by positioning the leading edge 46 of the second tobacco web 33 adjacent to, and not overlapping, the trailing edge 47 of the first tobacco web 34, there is no increase in the thickness of the tobacco web 11 passing through the slitting unit 13.

FIGS. 6A to 6E illustrate the apparatus of the web changeover unit 35 for performing the method illustrated in FIGS. 5A to 5E. As shown, the web changeover unit 35 includes a support 51 and a cutter 50. The cutter 50 cuts the first tobacco web 34 and the second tobacco web 33 on the support.

In the illustrated example, the web changeover unit 35 includes a single cutter 50 that cuts both of the first tobacco web 34 and the second tobacco web 33. However, as described above, the web changeover unit 35 may alternatively have two cutters, one for each of the first tobacco web 34 and the second tobacco web 33.

The web changeover unit 35 also includes a first nip drive 48 that drives the first tobacco web 34, and a second nip drive 49 that drives the second tobacco web 33. The first nip drive 48 and the second nip drive 49 each comprise two rollers between which the first and second tobacco webs 34, 33, respectively, are driven. The first and second nip drives 48, 49 are independently driven and can the direction of drive can also be changed. This allows the first tobacco web 34 and the second tobacco web 33 to be independently advanced and retracted, as per the method described with reference to FIGS. 5A to 5E.

An output nip drive 52 is provided at the downstream end of the cutter 50, as shown. The output nip drive 52 also includes two rollers between which the tobacco web 11 is driven. In this example, once a portion of tobacco web 11 passes the output nip drive 52 it can no longer be retracted.

A support 53 is provided between the output nip drive 52 and the slitting unit 13. The support 53 carries the leading edge of a cut tobacco web 34, 33 to the slitting unit 13. The support 53 may be a surface across which the tobacco web 34, 33 slides, or it may be a conveyor, for example a belt conveyor.

Figure 6A:
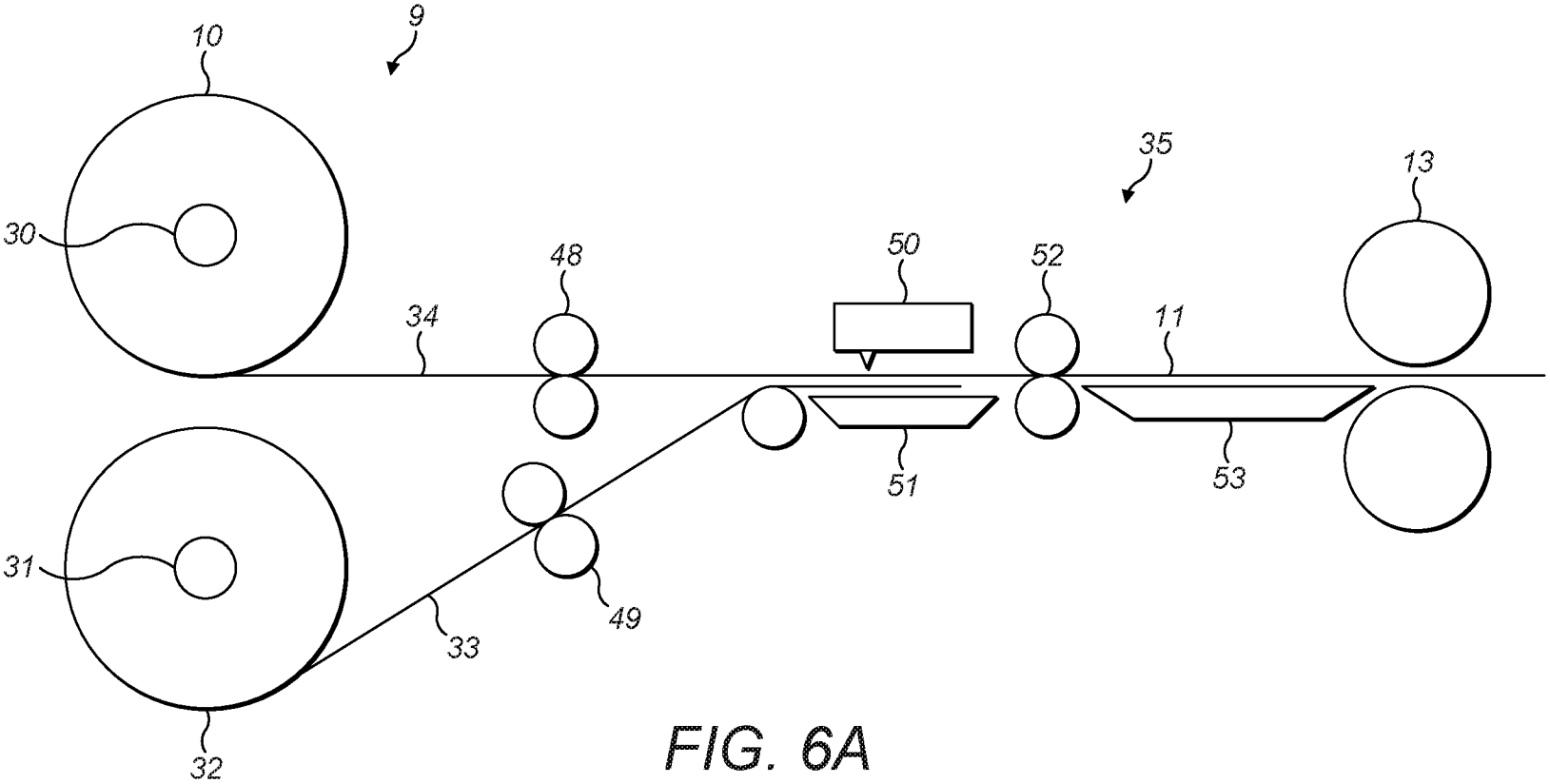
FIGS. 6A to 6E show apparatus including a web changeover unit that performs the process of FIGS. 5A to 5E; and, FIG. 7 shows apparatus having two sets of web feed units and two web changeover units.

As shown in FIG. 6A, the first tobacco web 34 is unreeled from the first reel 10 and fed into the web changeover unit 35. From there, the first tobacco web 34 exits the web changeover unit 35 as tobacco web 11 and passes to the slitting unit 13 and on through the remainder of the apparatus (8, see FIG. 2).

Specifically, the first tobacco web 34 passes through the first nip drive 48, between the cutter 50 and support 51, through the output nip drive 52, over the support 53, and into the slitting unit 13. In the condition illustrated in FIG. 6A, the first tobacco web 34 is the tobacco web 11 and is used to produce discrete tobacco rods, as described previously.

In preparation for changeover, the second tobacco web 33 from the second reel 32 is positioned in the web changeover unit 35. The web changeover unit 35 changes from the first tobacco web 34 to the second tobacco web 33 when the first reel 10 is empty or nearly empty.

Specifically, the second tobacco web 33 passes through the second nip drive 49, and a leading part of the second tobacco web 33 is positioned between the cutter 50 and support 51.

In the condition illustrated in FIG. 6A, the web changeover unit 35 is primed for changeover when the first reel 10 is empty or nearly empty.

Figure 6B:
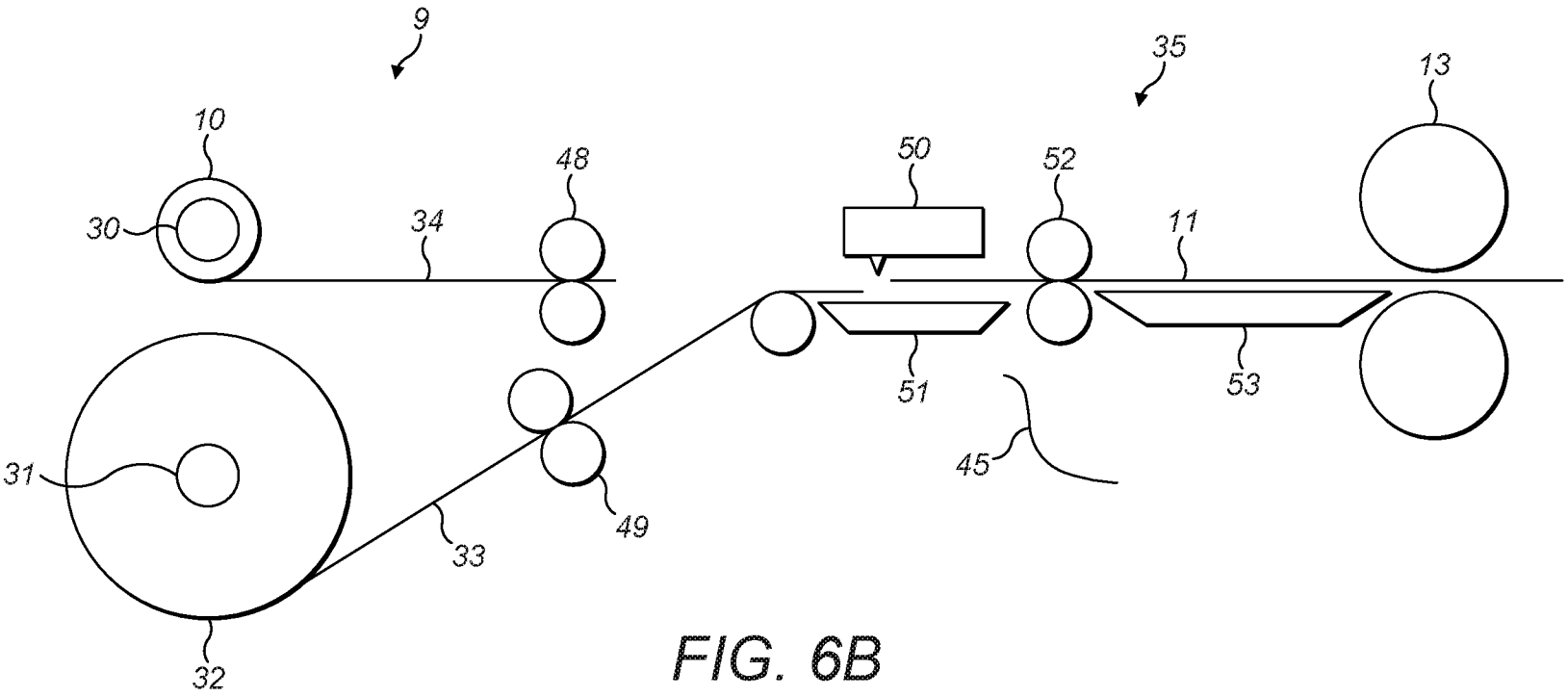

FIG. 6B illustrates a first step of the changeover process performed by the web changeover unit 35. As shown, the cutter 50 has cut the first tobacco web 34 and the second tobacco web 33. As described previously, in an alternative example the first tobacco web 34 and the second tobacco web 33 may have been cut by two separate cutters.

The first nip drive 48 and/or the first reel support 30 has withdrawn the remainder of the first tobacco web 34 towards the first reel 10. The cut-off part 45 of the second tobacco web 33 is removed, for example by suction.

At this stage, the leading edge 46 of the second tobacco web 33 is positioned adjacent to the trailing edge 47 of the first tobacco web 34. If the cutter 50 has cut both of the first tobacco web 34 and the second tobacco web 33 simultaneously then the leading edge 46 of the second tobacco web 33 and the trailing edge 47 of the first tobacco web 34 are already positioned adjacent to each other. In examples in which the second tobacco web 33 and the first tobacco web 34 are cut separately, then the second nip drive 49 can be used to position the second tobacco web 33 such that the leading edge 46 of the second tobacco web 33 is positioned adjacent to the trailing edge 47 of the first tobacco web 34.

In some examples, a sensor, for example a camera, can be arranged to inspect the relative positions of the leading edge 46 of the second tobacco web 33 and the trailing edge 47 of the first tobacco web 34. If adjustments are needed, the second nip drive 49 can move the second tobacco web 33 accordingly.

Figure 6C:
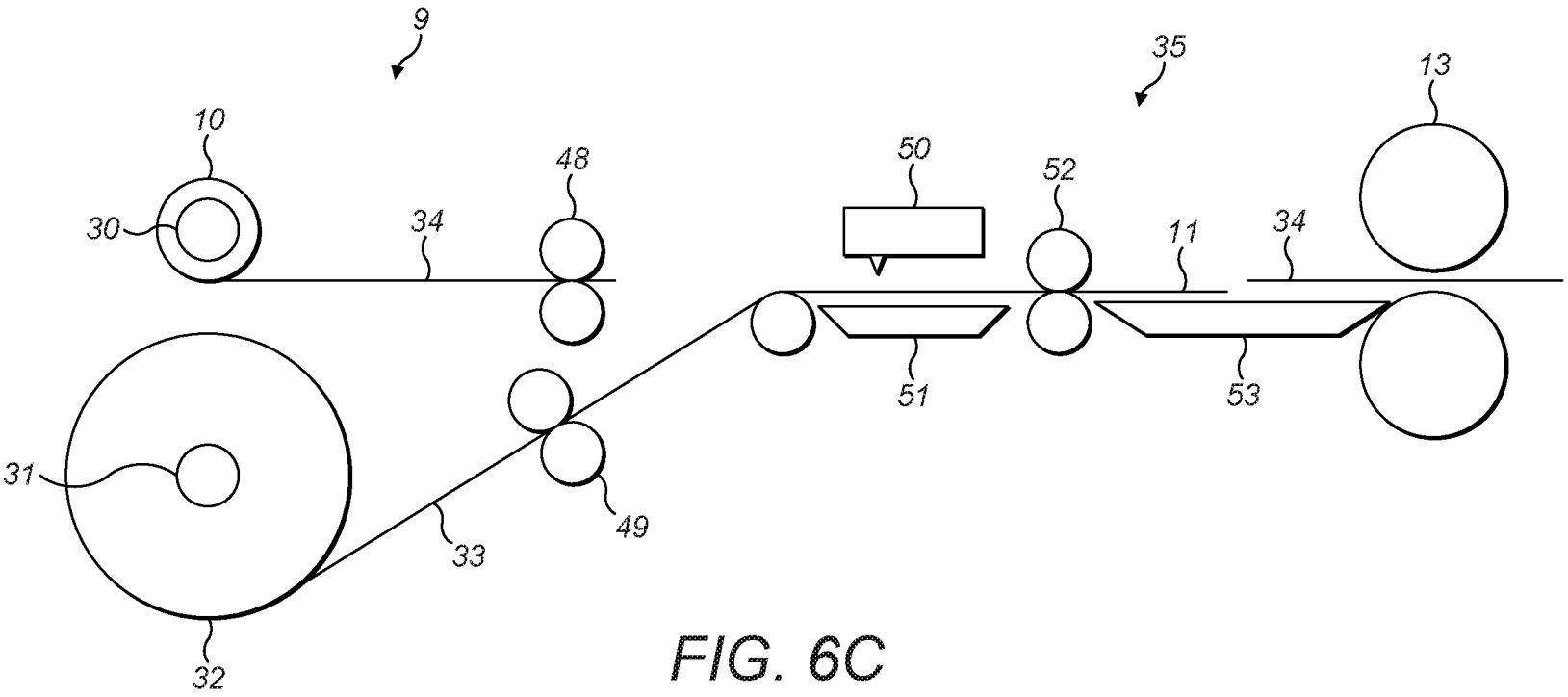
Figure 6D:
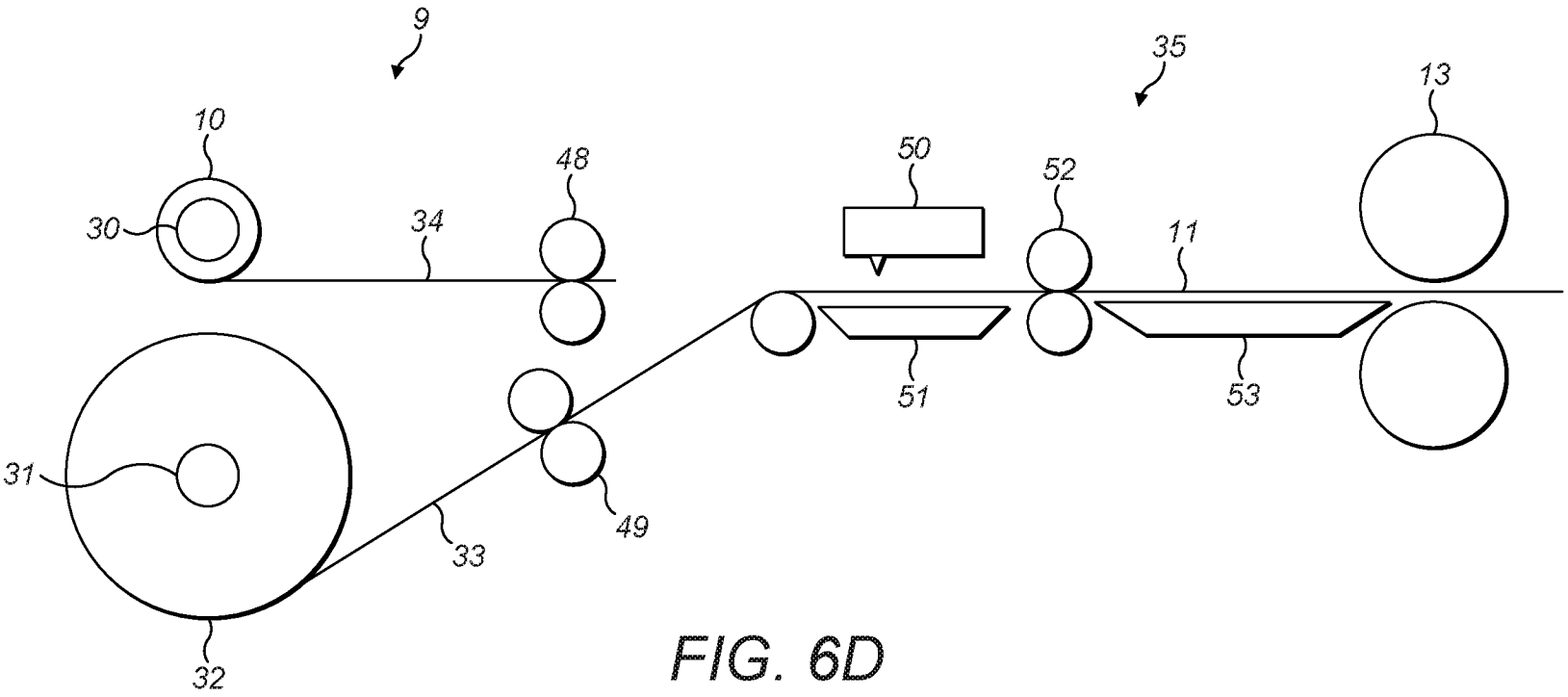

As shown in FIG. 6C, once the trailing edge 47 of the first tobacco web 34 and the leading edge 46 of the second tobacco web 33 have passed the output nip drive 52, their relative positions are fixed. The output nip drive 52 can grip both the first tobacco web 34 and the second tobacco web 33 simultaneously due to the diagonal cut, as shown in FIG. 5E. The support 53 carries the leading edge of the second tobacco web 33 to the slitting unit. As shown in FIG. 6D, thereafter the second tobacco web 33 is drawn through the remainder of the apparatus (8, see FIG. 2) as the tobacco web 11.

Figure 6E:
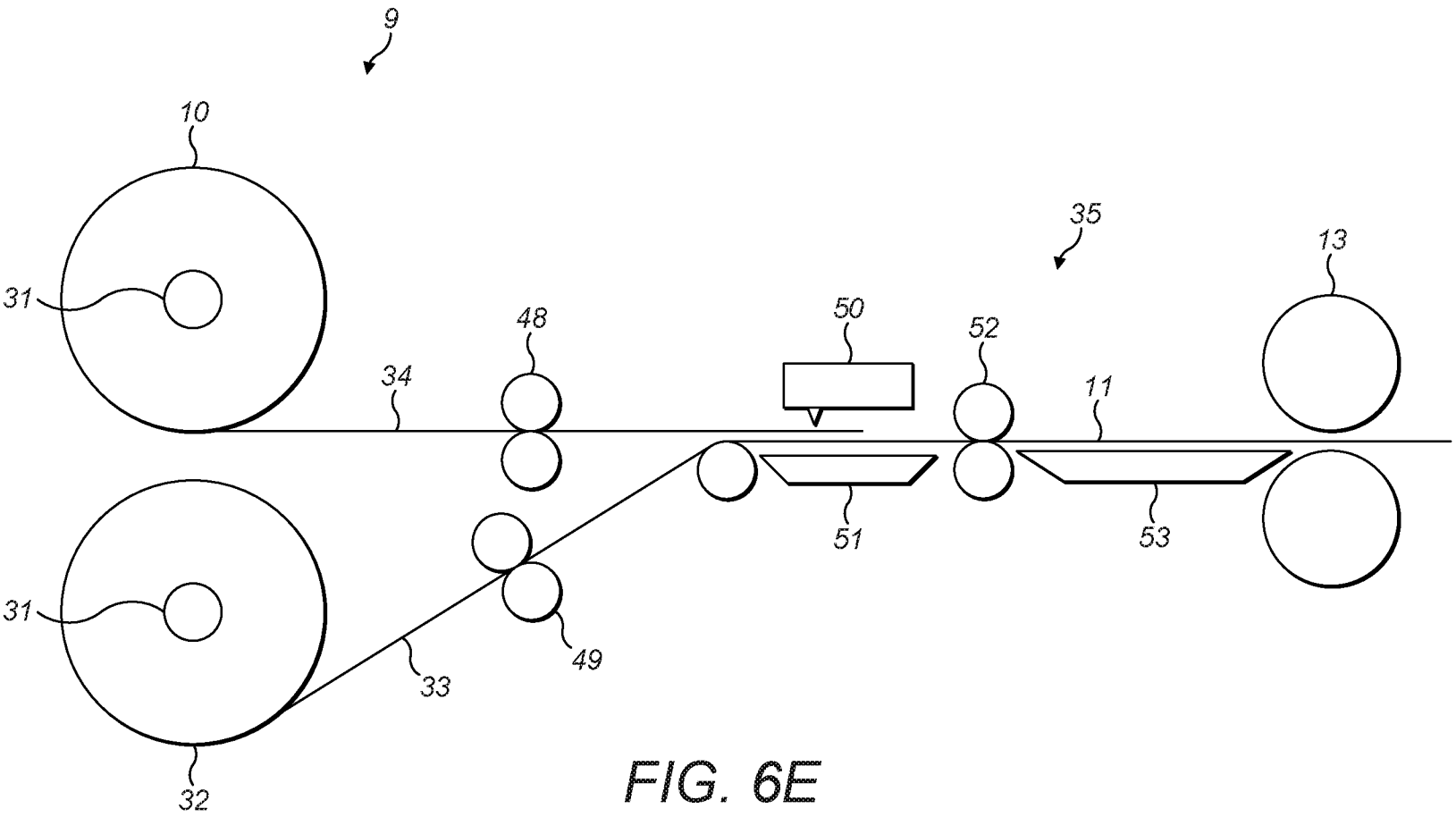

As shown in FIG. 6E, the first reel m can be replaced and a new first tobacco web 34 can be positioned in the web changeover unit 35. Once the second reel 32 is empty or close to empty, the web changeover unit 35 can change supply from the second tobacco web 33 to the first tobacco web 34.

In some examples, it may be preferable to stop movement of the first and second tobacco webs 34, 33 at the web changeover unit 35 during changeover from one to the other. This can be achieved by providing a buffer, for example a dancing arm, downstream of the web changeover unit 35. As will be appreciated by the skilled person, a dancing arm is a form of web buffer in which one or more rollers can move relative to one or more other rollers to provide a web path of varying length. A dancing arm is full when the rollers are at maximum separation, and moving the rollers towards each other allows output of the web from the dancing arm to continue while input of the web into the dancing arm is stopped. Such a buffer permits the first and second tobacco webs 34, 33 to be stationary within the web changeover unit 35 for a short time while tobacco web is drawn from the buffer. Such arrangements would be familiar to the skilled person.

Figure 7:
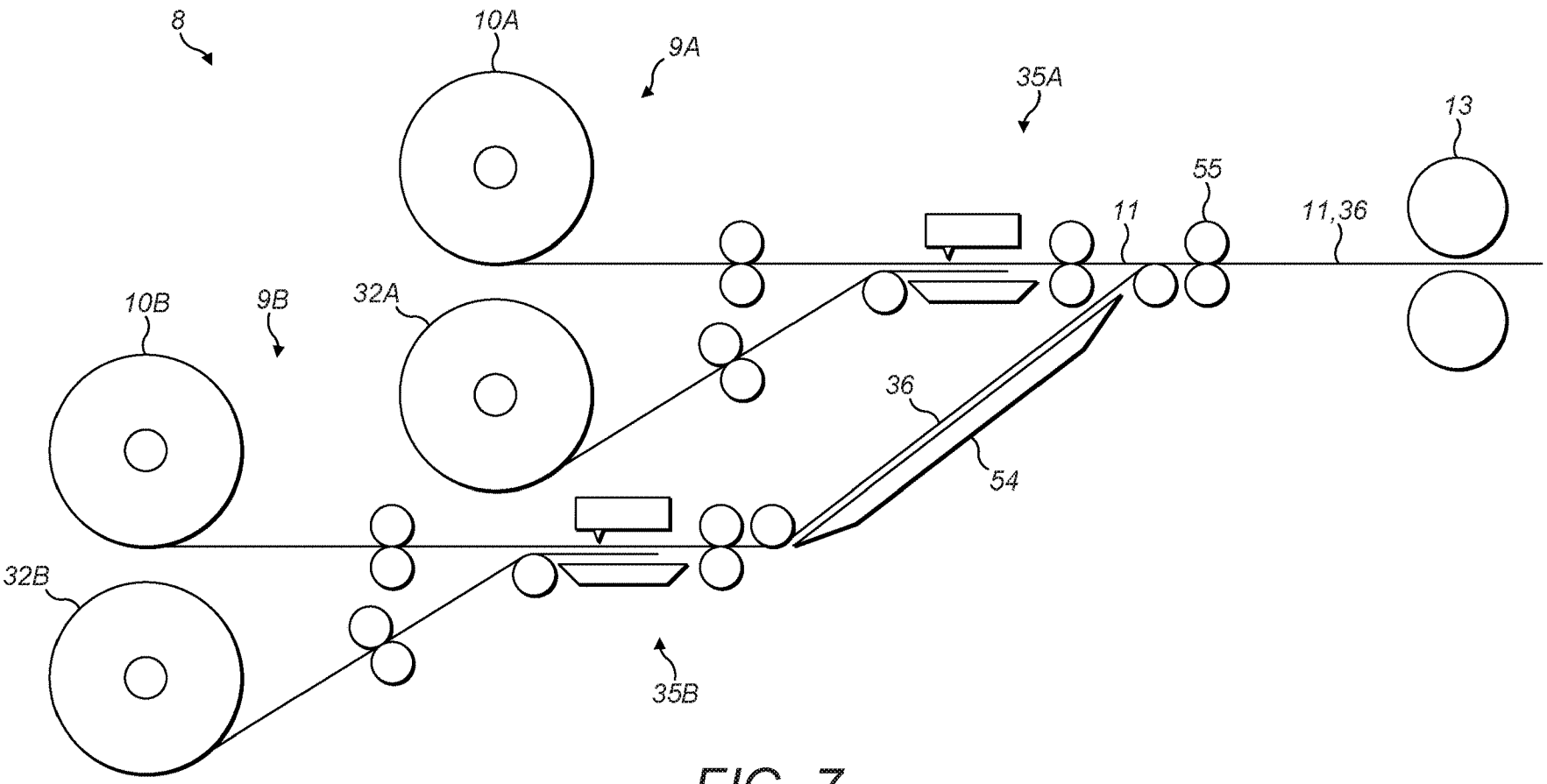

FIG. 7 shows an example apparatus 8 similar to the apparatus of FIG. 3. The apparatus 8 has first and second tobacco web feed units 9A, 9B and first and second web changeover units 35A, 35B, each being as described hereinbefore. This arrangement provides a further tobacco web 36 that overlaps the tobacco web 11, as illustrated. The double-thickness tobacco web 11, 36 means that the slitting unit 13 will produce a higher density of tobacco strands 14.

As illustrated in FIG. 7, a support 54 is provided to carry the leading edge of the further tobacco web 36 from the second web changeover unit 35B to where the tobacco web 11 and further tobacco web 36 are combined. The support 55 may be a surface over which the further tobacco web 36 is pushed, or it may be a conveyor, for example a belt conveyor.

In the example of FIG. 7, the apparatus 8 optionally further includes an embossing unit 55. The embossing unit is disposed downstream of the location where the tobacco web 11 and further tobacco web 36 are combined. When one of the tobacco web 11 and further tobacco web 36 are replaced (by one of the first and second web changeover units 35A, 35B), the embossing unit 55 acts to emboss the leading part of the new tobacco web 11 or 36 to other further tobacco web 11 or 36. In this way, the new tobacco web 11 or 36 is carried to the slitting unit by the other tobacco web 11 or 36. In this way, the support 53 described with reference to FIGS. 6A to 6E is not required.

The embossing unit 55 may be configured to emboss the tobacco web 11 and the further tobacco web 36 to each other only in the region where one of the tobacco webs 11, 36 has been changed over. Alternatively, the embossing unit 55 may be configured to emboss the tobacco web 11 and the further tobacco web 36 to each other along the length of the tobacco web 11 and the further tobacco web 36.

It will be appreciated that in the example of FIG. 7 in which the tobacco web 11 and further tobacco web 36 are embossed to each other, the reels 10A, 32A, 10B, 32B are arranged so that they do not expire at the same time, such that one of the tobacco webs 11, 36 is able to carry the leading part of the other tobacco web 11, 36 after changeover.

Significantly, the web changeover unit 35 or units 35A, 35B do not attach the first tobacco web 34 to the second tobacco web 33 during changeover between the first and second tobacco webs 34, 33. Instead, as described with reference to FIGS. 5A to 5E, the leading edge 46 of the second tobacco web 33 is positioned adjacent to the trailing edge 47 of the first tobacco web 34. The leading edge 46 of the second tobacco web 33 might abut the trailing edge 47 of the first tobacco web 34, or leading edge 46 of the second tobacco web 33 might be spaced from the trailing edge 47 of the first tobacco web 34. As there is no overlap or connection between the first tobacco web 34 and the second tobacco web 33, there is no localised increase in thickness, and no change in materials, and the tobacco web 11 can pass through the slitting unit 13 and other parts of the apparatus 8.

The above examples are to be understood as illustrative examples of the invention.

For example, although in the above examples the tobacco web 11 is described as being a sheet of reconstituted tobacco, this need not necessarily be the case, and in other examples, the tobacco web 11 may be made of other materials. The tobacco web 11 may or may not comprise glycerol, and may comprise other materials, such as additives or enhancers, alternatively or additionally to glycerol.

Although in the above examples the tobacco strands 14 are described as being straight and parallel to one another, this need not necessarily be the case, and in other examples the tobacco strands 14 may not be substantially straight and/or may not be substantially parallel to one another. For example, the tobacco strands 14 may undergo processing so as to comprise a longitudinal wave or corrugation or zig-zag shape or the like, or indeed the tobacco web 11 may inherently comprise a longitudinal wave or corrugation or zig-zag shape or the like or be processed so as to have such a shape or configuration. Indeed, the tobacco rod segment 1 may comprise any tobacco rod 3 formed of a plurality of longitudinal tobacco strands 14, wherein each of the plurality of longitudinal tobacco 14 strands are substantially non-coiled.

Although in some of the above examples the tobacco rod segment 1 is described as being a consumable for a "heat-not-burn" device or the like comprising a blade heater 15, this need not necessarily be the case, and in other examples the tobacco rod segment 1 may be used in other devices and/or for other purposes. For example, the tobacco rod segment 1 may be a consumable of any aerosol generating device, for example tobacco heating products or devices not necessarily comprising a blade heater 15.

Although in the above examples the tobacco web 11 is described as being or comprising tobacco, for example reconstituted tobacco, this need not necessarily be the case and in other examples the sheet may be or comprise a sheet of any aerosol-generating material. The aerosol-generating material may be a material which when heated, for example by the blade heater 15 of an overall aerosol generating device, produces an aerosol. For example, the sheet of aerosol generating material may be or comprise a flavour substrate. The flavour substrate may comprise flavour, such as tobacco flavour or other flavour and/or may comprise glycerol or other additives or enhancers alternatively or additionally to glycerol. The flavour substrate, with or without glycerol or other additives, may be heated to produce an aerosol.

It may be noted that, in general, an aerosol is a colloid of fine solid particles or liquid droplets, in air or another gas, where a colloid is a substance in which microscopically dispersed insoluble particles are suspended throughout another substance. On the other hand, a vapour is a substance in the gas phase at a temperature lower than its critical temperature, which means that for example the vapour can be condensed to a liquid by increasing its pressure without reducing the temperature. It is to be understood that as used herein the term aerosol includes aerosol and/or vapour.

It will be appreciated that in some examples, aerosol-generating material rod segments may be made from a web of aerosol-generating material, as described above for a reconstituted tobacco web, for example by cutting the sheet of aerosol-generating material longitudinally to produce a plurality of aerosol-generating material strands; gathering the strands together to form an aerosol-generating material rod in which each of the plurality of aerosol-generating material strands is substantially non-coiled; and cutting the aerosol-generating material rod into segments to produce the aerosol-generating material rod segments.

Similarly, it will be appreciated that a product may comprise a rod of aerosol-generating material, wherein the rod of aerosol-generating material is formed of a plurality of longitudinal strands of aerosol-generating material, wherein each of the plurality of longitudinal strands of aerosol-generating material is substantially non-coiled.

As used herein, the terms "upstream" and "downstream" refer to a position within the apparatus relative to the direction that the aerosol-generating material moves through the apparatus. Therefore, "upstream" refers to a position in the direction of the reel of tobacco web, and "downstream" refers to a position in the direction of the cutting unit, as illustrated in FIG. 2.

In order to address various issues and advance the art, the entirety of this disclosure shows by way of illustration various embodiments in which the claimed invention(s) may be practiced and provide for superior apparatus for producing rods of aerosol-generating material. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. Apparatus for producing a rod of aerosol-generating material, the apparatus comprising:

a first feed device adapted to supply a first web of aerosol-generating material to a processing unit;

a second feed device adapted to supply a second web of aerosol-generating material; and a web changeover unit arranged to change supply of aerosol-generating material to the processing unit from the first web of aerosol-generating material to the second web of aerosol-generating material as supply of the first and second webs of aerosol-generating material towards the processing unit continues;

wherein the web changeover unit is configured to position a leading edge of the second web of aerosol-generating material adjacent to a trailing edge of the first web of aerosol-generating material upstream of the processing unit such that said leading and trailing edges do not overlap, during changeover from the first web of aerosol-generating material to the second web of aerosol-generating material, and wherein the leading edge of the second web of aerosol-generating material and the trailing edge of the first web of aerosol-generating material are complementarily shaped, and wherein the leading edge of the second web of aerosol-generating material and the trailing edge of the first web of aerosol-generating material are diagonal relative to the direction of travel of the leading edge of the second web of aerosol-generating material and the first web of aerosol-generating material, wherein the changeover unit is configured such that the first web of aerosol-generating material and the second web of aerosol-generating material are not attached during change of supply of aerosol-generating material.

2. The apparatus of claim 1, wherein the web changeover unit is configured to position the leading edge of the second web of aerosol-generating material to abut the trailing edge of the first web of aerosol-generating material.

3. The apparatus of claim 1, wherein the web changeover unit is configured to position the leading edge of the second web of aerosol-generating material relative the trailing edge of the first web of aerosol-generating material such that a space is defined between the leading edge of the second web of aerosol-generating material and the trailing edge of the first web of aerosol-generating material.

4. The apparatus of claim 3, wherein the space is less than 20 mm.

5. The apparatus of claim 1, wherein the web changeover unit is configured to position the leading edge of the second web of aerosol-generating material adjacent to the trailing edge of the first web of aerosol-generating material without overlap between the first web of aerosol-generating material and the second web of aerosol-generating material.

6. The apparatus of claim 1, further comprising a support arranged to carry the leading edge of the second web of aerosol-generating material to the processing unit.

7. The apparatus of claim 1, further comprising a cutting unit arranged to cut the first web of aerosol-generating material to define the trailing edge.

8. The apparatus of claim 1, further comprising a cutting unit arranged to cut the second web of aerosol-generating material to define the leading edge.

9. The apparatus of claim 7, wherein the cutting unit is further arranged to cut the second web of aerosol-generating material to define the leading edge.

10. The apparatus of claim 7, wherein the cutting unit is configured to cut the web of aerosol-generating material in a diagonal direction.

11. The apparatus of claim 1, wherein the web changeover unit comprises a nip drive roller configured to drive the second web of aerosol-generating material.

12. The apparatus of claim 11, wherein the web changeover unit further comprises a sensor for detecting the positions of the leading edge of the second web of aerosol-generating material and the trailing edge of the first web of aerosol-generating material.

13. The apparatus of claim 12, further comprising a controller configured to control the nip drive roller to position the leading edge of the second web of aerosol-generating material adjacent to the trailing edge of the first web of aerosol-generating material.

14. The apparatus of claim 1, further comprising a further web feed unit for providing a further web of aerosol-generating material to the processing unit, the further web of aerosol-generating material being arranged to overlap with the web of aerosol-generating material in the processing unit.

15. The apparatus of claim 14, wherein the further web feed unit comprises:

a first feed device adapted to supply a first web of aerosol-generating material to the processing unit;

a second feed device adapted to supply a second web of aerosol-generating material; and a web changeover unit arranged to change supply of aerosol-generating material to the processing unit from the first web to the second web;

wherein the web changeover unit is configured to position a leading edge of the second web of aerosol-generating material adjacent to a trailing edge of the first web of aerosol-generating material upstream of the processing unit.

16. The apparatus of claim 14, further comprising an embossing unit configured to emboss the second web of aerosol-generating material to the further web of aerosol-generating material.

17. The apparatus of claim 16, wherein the embossing unit is configured to emboss a portion of the second web of aerosol-generating material adjacent to the leading edge to the further web of aerosol-generating material.

18. The apparatus of claim 1, wherein the process unit is a slitting unit for slitting the web of aerosol-generating material into a plurality of strands of aerosol-generating material.

* * * * *